US006185783B1

(12) United States Patent
Carpinella

(10) Patent No.: US 6,185,783 B1
(45) Date of Patent: Feb. 13, 2001

(54) GARAGE DOOR ROLLER ASSEMBLY

(75) Inventor: Ralph Carpinella, Middlebury, CT (US)

(73) Assignee: Carpin Manufacturing, Inc., Waterbury, CT (US)

( * ) Notice: Under 35 U.S.C. 154(b), the term of this patent shall be extended for 0 days.

(21) Appl. No.: 09/456,863

(22) Filed: Dec. 8, 1999

(51) Int. Cl.[7] ..... A47H 15/00; E05D 15/00
(52) U.S. Cl. ..... 16/91; 16/107; 160/201
(58) Field of Search ..... 16/91, 97, 98, 16/107, 106; 160/201, 209, 235

(56) References Cited

U.S. PATENT DOCUMENTS 4,205,713 * 6/1980 Galbreath ..... 160/201
4,379,479 * 4/1983 Whiting ..... 160/201
4,494,271 * 1/1985 Perlin et al. ..... 16/30
5,566,740 * 10/1996 Mullet et al. ..... 16/355
6,081,966 * 7/2000 Antekeier et al. ..... 16/91

* cited by examiner

*Primary Examiner*—Chuck Y. Mah
(74) *Attorney, Agent, or Firm*—Alix, Yale & Ristas, LLP

(57) ABSTRACT

A garage door roller assembly includes a one-piece, unitary shaft and a one-piece, unitary roller, each composed of a polymeric material and a washer and a pin, each composed of case-hardened steel. The roller includes a sleeve portion having an axial bore, a wheel portion, and a web extending radially from the wheel portion to the sleeve portion. The shaft includes an axial bore, a mounting portion, and a race portion. The race portion is rotatably mounted within the bore of the sleeve portion of the roller. The pin includes a head and a stem which extends axially from the head through the opening of the washer into the bore of the shaft. A knurled segment of the stem frictionally engages the bore of the shaft.

19 Claims, 3 Drawing Sheets

GARAGE DOOR ROLLER ASSEMBLY

BACKGROUND OF THE INVENTION

This invention relates generally to roll-up or upwardly-acting overhead doors. More particularly, the present invention relates to a roller assembly intended for use on a garage overhead door.

Upwardly-acting overhead doors are commonly utilized as garage doors and conventionally employ a plurality of door sections which are hinged together. Such overhead doors are generally supported on a pair of L-shaped tracks for permitting the door to move upwardly from a substantially vertical closed position to a substantially horizontal opened position. To permit this opening and closing movement, the garage door is provided with a plurality of roller support units disposed adjacent the side edges of the door. A roller of each roller support unit is rollingly engaged with and supported by the stationary L-shaped track. Commonly, the roller support unit also includes a pair of hinge halves which are fixed to the adjacent door sections and disposed in opposed relationship. The hinge halves support a metal hinge tube in which the shaft of the roller is received.

The roller of many conventional roller support units is composed of metal and the metal-to-metal contact between the roller and the L-shaped track produces a large amount of undesirable noise when the door moves one position to another. In addition, such roller support units are generally composed of ordinary steel to minimize the material cost. Although the roller support units are generally installed on the interior side of the overhead door, they receive significant exposure to the elements and are subject to rust and other corrosion problems. Such corrosion increases the amount of noise produced by the door and can lead to failure of the roller support unit.

In an attempt to improve upon the above-described roller support unit, some conventional roller support units are provided with plastic rollers which are rotatably mounted on a metal roller shaft. The amount of noise produced by such roller support units is lower than that produced by roller support units having metal rollers. In addition, the plastic rollers are not subject to corrosion. However, these roller support units are generally more expensive to manufacture than the all-steel roller units and therefore are not cost competitive.

SUMMARY OF THE INVENTION

Briefly stated, the invention in a preferred form is a garage door roller assembly which includes a one-piece, unitary shaft and a one-piece, unitary roller, each composed of a polymeric material, and a washer and a pin, each composed of case-hardened steel. The roller includes a sleeve portion having an axial bore, a wheel portion, and a web extending radially from the wheel portion to the sleeve portion. The shaft includes an axial bore, a mounting portion, and a race portion. The race portion is rotatably mounted within the bore of the sleeve portion of the roller. The pin includes a head and a stem which extends axially from the head through the opening of the washer into the bore of the shaft. A knurled segment of the stem frictionally engages the bore of the shaft.

The shaft also has a radially extending shoulder portion positioned between the mounting portion and the race portion. The outside diameter of the race portion is smaller than the outside diameter of the shoulder portion, forming a distal shoulder adjacent the race portion of the shaft. The sleeve portion of the roller extends axially beyond the proximal edge of the wheel portion to a lip which slidably engages the distal shoulder of the shaft. A circular rim extends outwardly from the distal surface from the web of the roller to form a receptacle for receiving and positioning the washer.

The knurled segment of the stem has a plurality of ridges which extend radially outward from the surface of the stem and which extend an axial distance on the outside surface of the stem. The outside diameter defined by the ridges is greater than the inside diameter of the bore of the shaft.

It is an object of the invention to provide a new and improved roller assembly for an overhead door which has improved wear characteristics.

It is also an object of the invention to provide a new and improved roller assembly which is not subject to corrosion and which produces less noise during operation.

It is further an object of the invention to provide a new and improved roller assembly which may be manufactured inexpensively.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 2:
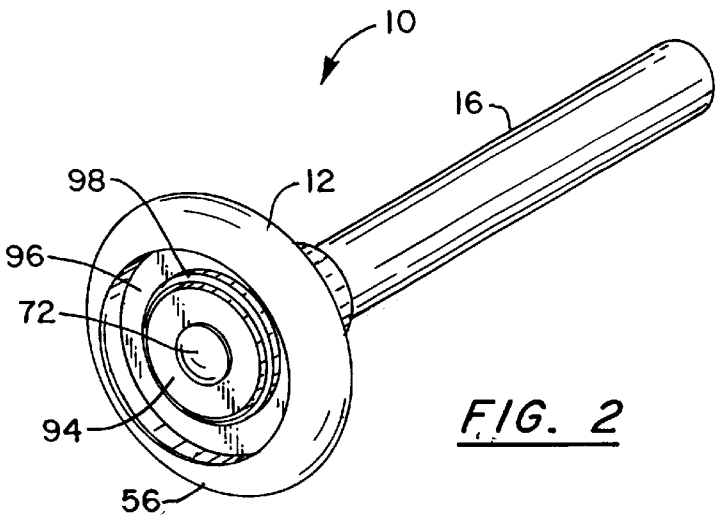
FIG. 2 is an enlarged perspective view of the roller assembly of FIG. 1.
Figure 3:
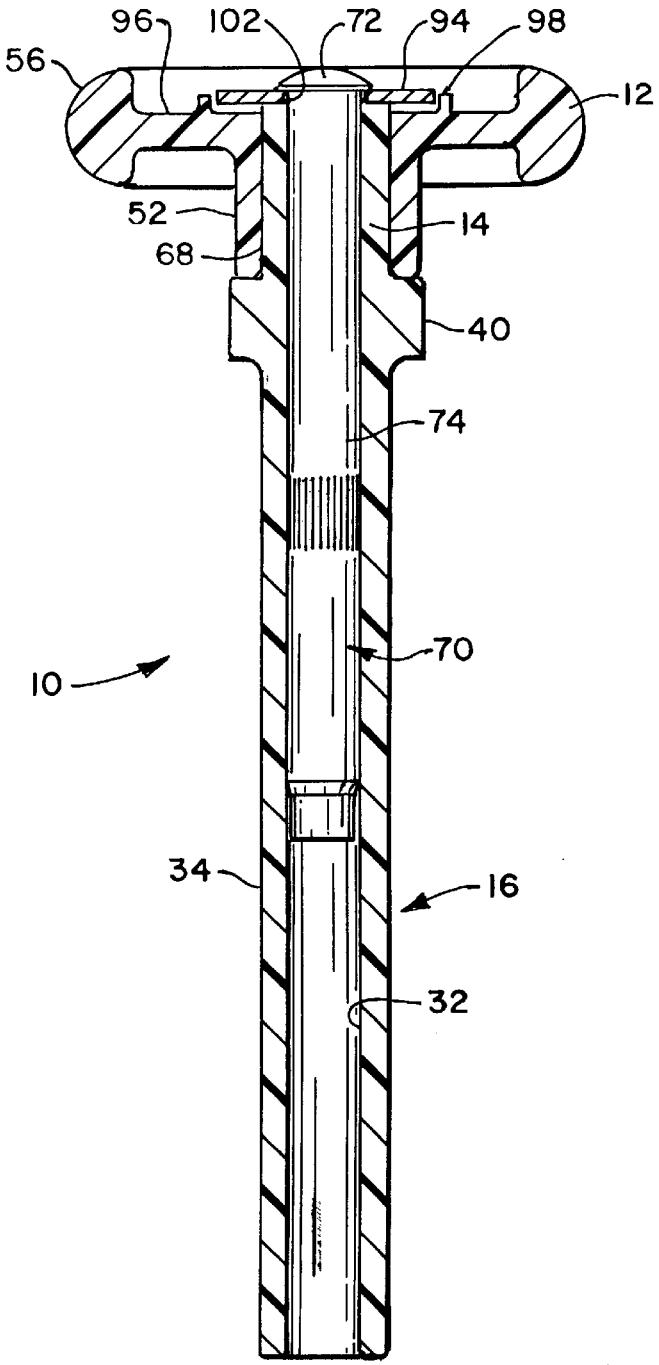
FIG. 3 is a cross-sectional view of the roller assembly of FIG. 2.

With reference to the drawings wherein like numerals represent like parts throughout the several figures, a garage door roller assembly in accordance with the present invention is generally designated by the numeral 10. As shown in FIGS. 2 and 3, each roller assembly 10 includes a roller 12 which is rotatably mounted on a race portion 14 of shaft 16. A number of the roller assemblies 10 are mounted to the interior surface 18 of the garage door 20 along each side edge such that the race portion of the shaft extends beyond the side edge 22 of the door 20 and the rollers 12 are positioned at a substantially uniform distance from the side edge 22 of the door 20. The rollers 12 on each side of the garage door 20 are rollingly engaged with and supported by one of a pair of stationary L-shaped tracks 24. The L-shape of the tracks 24 permits the door 20 to move upwardly from a substantially vertical, closed position to a substantially horizontal, opened position.

Figure 1:
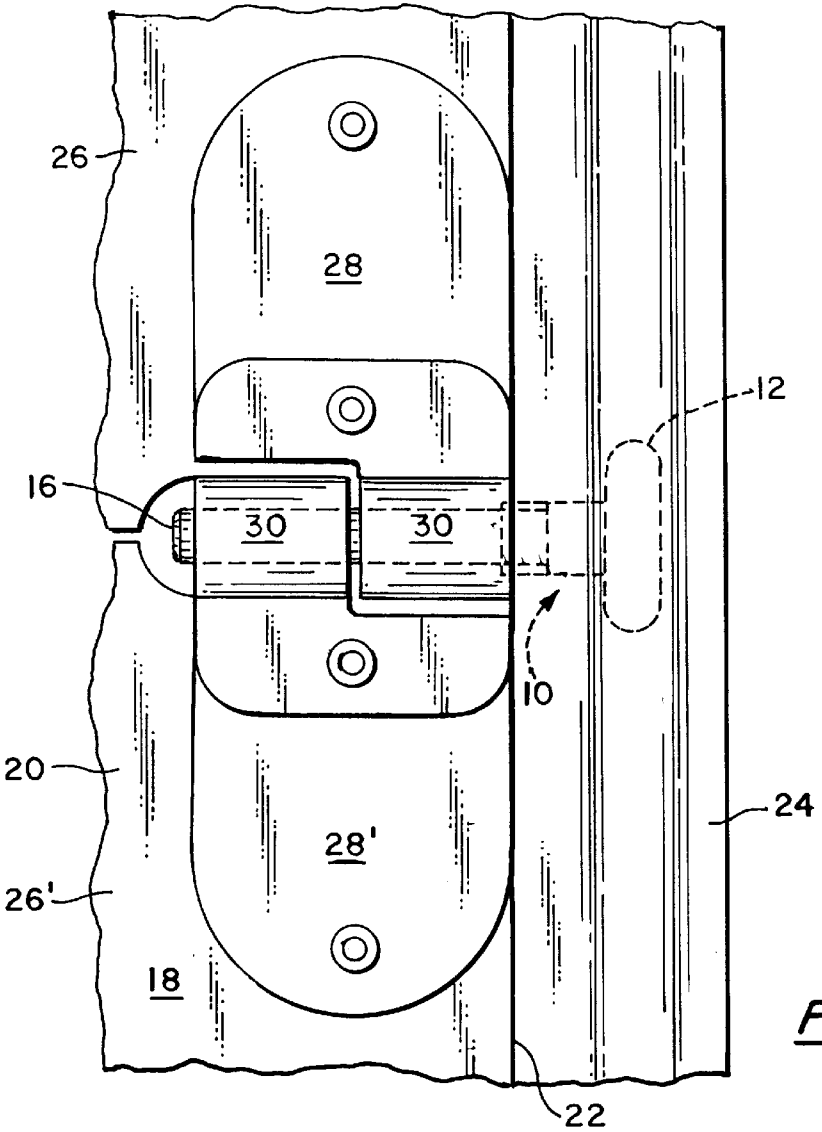
FIG. 1 an elevational view, partly in phantom, of a garage door having a roller assembly in accordance with the invention.

Conventionally, garage doors 20 employ a plurality of door sections 26, 26' which are hinged together (FIG. 1). The pair of hinge halves 28, 28' which are used to join adjacent door sections 26, 26' commonly support a metal hinge tube 30 in which the shaft 16 of the roller assembly 10 is received. Typically the shaft 16 may act as a pivot pin to join the hinge halves 28, 28' together, permitting rotational movement between the hinge halves 28, 28' and the door sections 26, 26' mounted on the hinge halves 28, 28'.

Figure 4:
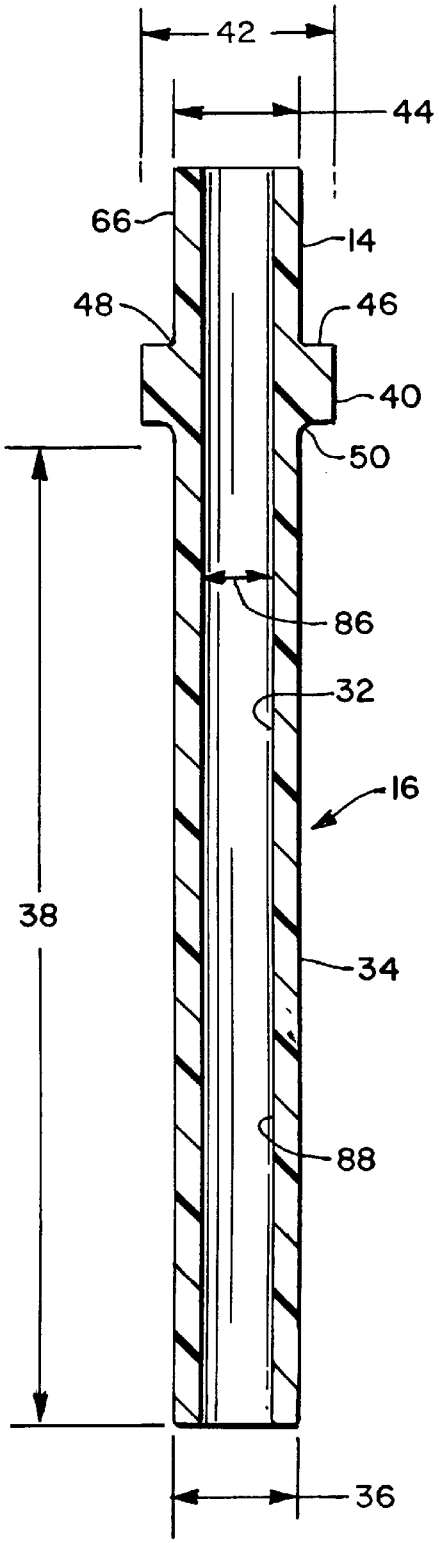
FIG. 4 is a cross-sectional view of the roller shaft of FIG. 2.

With reference to FIG. 4, the shaft 16 of the roller assembly 10 is a unitary, one-piece unit, manufactured from a high-strength polymeric material. In a preferred embodiment, the shaft 16 is manufactured in a casting process from either a grade nylon or polybutylene terephthalate (PBT). The shaft 16 is in the form of a cylinder having an axial bore 32, a first end portion or race portion 14 on which the roller 12 is mounted, and a second end portion or mounting portion 34 which is mounted to the door 20. Since the roller assembly 10 is intended to be interchangeable with conventional roller support units, the outside diameter 36 and length 38 of the mounting portion 34 are selected such that the mounting portion 34 will fit properly within conventional hinge tubes 30.

A shoulder portion 40 is disposed intermediate the mounting portion 34 and the race portion 14. The outside diameter 42 of the shoulder portion 40 is greater than the outside diameter 44, 36 of the race and mounting portions 14, 34 to provide a distal shoulder 46 adjacent the race portion 14 of the shaft 16. The combined length of the mounting portion 34, the shoulder portion 40, and the race portion 14 are selected such that the race portion 14 will be properly positioned in the L-shaped track 24 of a conventional garage door 20.

Race and mounting transition segments 48, 50 provide an interface between the race portion 14 and mounting portion 34, respectively, and the shoulder portion 40. Each of the transition segments 48, 50 has an arcuate surface to blend the outside surface of the race and mounting portions with the side surfaces of the shoulder portion 40. Blending the surfaces prevents the formation of a sharp break which could concentrate stress at the transition. The radius of the arcuate surface of the race transition segment 48 is much smaller than the radius of the arcuate surface of the mounting transition segment 50 to maximize the surface area of the shoulder 46. For example, the radius for the race transition segment 48 may have a value of 0.015 degrees while the radius for the mounting transition segment 50 may have a value of 0.075 degrees.

The roller 12 of the roller assembly 10 is a unitary, one-piece unit, manufactured from an impact resistant polymeric material. In a preferred embodiment, the roller 12 is manufactured in a casting process from nylon 6 with rubber modifiers. The roller 12 includes a center sleeve portion 52 having an axial bore 54 for receiving the race portion 14 of the shaft 16. The roller 12 also includes an outer wheel portion 56 that engages the L-shaped track 24. The outer surface of the wheel portion 56 has a substantially semicircular shape when viewed in cross-section. The wheel portion 56 is connected to the sleeve portion 52 by a radially extending web 58.

Figure 6:
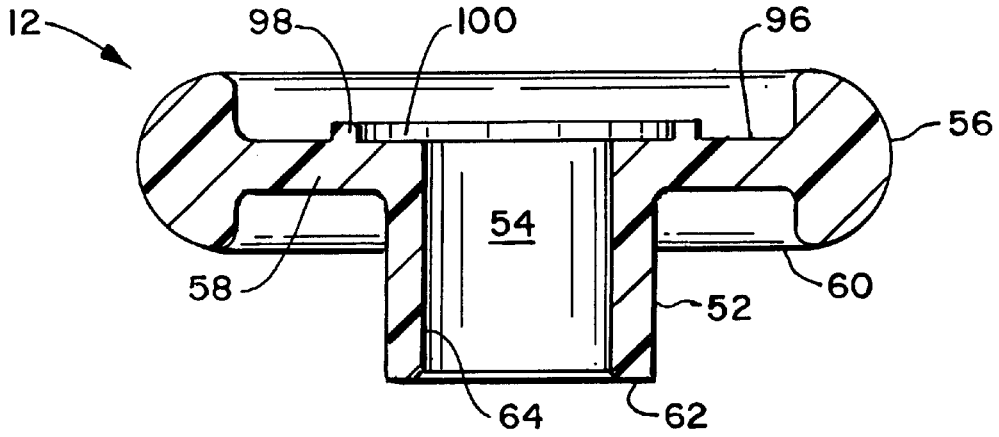
FIG. 6 is a cross-sectional view of the roller of FIG. 2.

As shown in FIG. 6, the sleeve portion 52 extends axially beyond the proximal edge 60 of the wheel portion 56 to a lip 62. The lip 62 is disposed adjacent the shoulder portion 40 of the shaft 16 and slidably engages the surface of the shoulder 46 in the assembled roller assembly 10. The polymeric material of the roller 12 and the shaft 16 minimize the friction between the inner surface 64 and lip 62 of the sleeve portion 52 and the outer surface 66 of the race portion 14 and surface of the shoulder 46. Preferably, a lubricant 68 such as grease is inserted between the roller 12 and the shaft 16 to further limit the friction.

Figure 5:
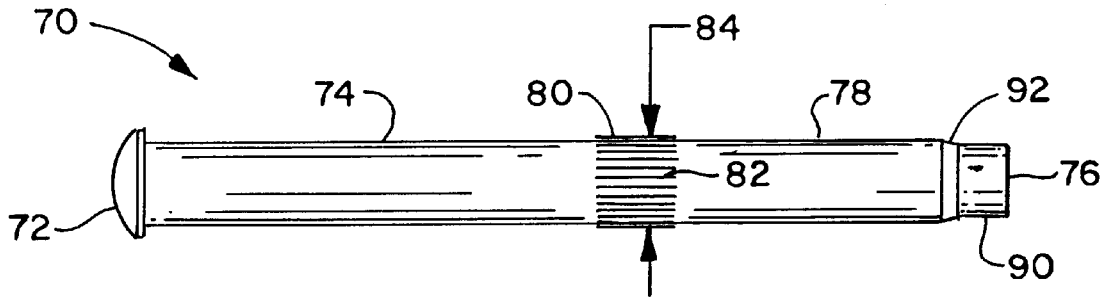
FIG. 5 is a side view of the knurled pin of FIG. 2.

The roller 12 is mounted on the race portion 14 of the shaft 16 by a pin 70 having a distal head 72 and a stem 74 extending axially from the head 72 to a proximal end 76 (FIG. 5). The surface 78 of the stem 74 has a knurled segment 80 positioned between the head 72 and the proximal end 76. Preferably, the knurling comprises a plurality of ridges 82 which extend axially and radially on the outside surface 73 of the stem 74. The outside diameter 84 of the knurled segment 80 is greater than the inside diameter 86 of the bore 32 of the shaft 16 such that the knurled segment 80 engages the inside surface 88 of bore 32 to retain the pin 70 and roller 12 to the shaft 16.

The proximal end portion 90 of the stem 74 may have a diameter which is smaller than the diameter of the main portion of the stem 74. The reduced diameter of the proximal end portion 90 facilitates insertion of the stem 74 into the bore 32 of the shaft 16. Preferably, a frustoconical-shaped transition segment 92 is disposed intermediate the main portion of the stem 74 and the proximal end portion 90. The shape of the transition segment 92 prevents the formation of a sharp break which could concentrate stress at the transition.

A washer 94 is disposed between the head 72 of the pin 70 and the distal surface 96 of the web 58 to spread the retaining force over a wider surface area of the roller 12. In the embodiment shown in FIGS. 2, 3 and 6, the distal surface 96 of the web 58 includes an outwardly extending circular rim 98 which is coaxial with the sleeve portion 52. The inside diameter of the rim 98 is slightly greater than the outside diameter of the washer 94 so that the washer 94 is received within the receptacle 100 formed by the rim 98 and positioned thereby such that the opening 102 of the washer 94 is coaxial with bore 54 and bore 32.

The washer 94 and pin 70 are preferably composed of case-hardened steel. The case hardening provides for superior wear characteristics. The use of steel allows the roller assembly 10 to withstand 150 miles-per-hour hurricane winds, a performance standard for the industry. It should be appreciated that the use of a roller 12 and a shaft 16 composed of polymeric material greatly reduces the amount of noise which is generated during the opening and closing of the garage door 20 on which the roller assembly 10 is mounted. It should be further appreciated that the bore 32 of the shaft 16 may be a blind bore having a length which is at least as long as the length of the pin stem 74.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A roller assembly for an entry way including an upwardly-acting overhead door having oppositely disposed side edges, a first L-shaped track positioned on a first side of the entry way, and a second L-shaped track positioned on a second side of the entry way, the roller assembly comprising:

a roller composed of a polymeric material, the roller having a sleeve portion defining an axial bore, a wheel portion engageable with one of the tracks, and a web extending radially from the wheel portion to the sleeve portion;

a shaft composed of a polymeric material, the shaft defining an axial bore and having a mounting portion and a race portion, the race portion being rotatably disposed within the bore of the sleeve portion of the roller, the mounting portion being mountable to the door wherein the race portion is positioned at a distance from one of the side edges;

a washer defining an opening and having oppositely disposed proximal and distal surfaces, the opening being coaxial with the bore of the sleeve portion of the roller, the proximal surface being slidably engaged with the web of the roller; and a pin having a head and a stem extending axially from the head to a proximal end, the stem extending through the opening of the washer and being frictionally engaged within the bore of the shaft, the head engaging the distal surface of the washer.

2. The roller assembly of claim 1 wherein the shaft is a unitary, one-piece unit and the roller is a unitary, one-piece unit.

3. The roller assembly of claim 1 wherein the shaft further has a shoulder portion disposed intermediate the mounting portion and the race portion, the race portion and the shoulder portion each having an outside diameter, the outside diameter of the shoulder portion being greater than the outside diameter of the race portion, defining a distal shoulder adjacent the race portion of the shaft.

4. The roller assembly of claim 3 wherein the wheel portion of the roller has oppositely disposed proximal and distal edges, the sleeve portion of the roller extending axially beyond the proximal edge of the wheel portion to a lip, the lip slidably engaging the distal shoulder of the shaft.

5. The roller assembly of claim 1 wherein the web of the roller has oppositely disposed proximal and distal faces and a circular rim extending outwardly from the distal surface, the rim defining a receptacle for receiving and positioning the washer.

6. The roller assembly of claim 1 wherein the pin further has a knurled segment disposed intermediate the head and the proximal end, the knurled segment having at least one radially extending protrusion frictionally engaging the bore of the shaft.

7. The roller assembly of claim 6 wherein the stem has an outside surface and the protrusions comprise a plurality of ridges extending axially on the outside surface of the stem, the outside diameter defined by the ridges being greater than the inside diameter of the bore of the shaft.

8. The roller assembly of claim 1 wherein the stem includes a proximal end portion and a main portion disposed intermediate the proximal end portion and the head, the main and proximal end portions each having a diameter, the diameter of the proximal end portion being smaller than the diameter of the main portion.

9. The roller assembly of claim 1 wherein the washer and pin are both composed of case-hardened steel.

10. The roller assembly of claim 1 wherein the shaft is composed of a grade nylon and the roller is composed of nylon 6 with rubber modifiers.

11. The roller assembly of claim 1 wherein the shaft is composed of polybutylene terephthalate and the roller is composed of nylon 6 with rubber modifiers.

12. A garage door roller assembly comprising:

a one-piece, unitary roller, composed of a polymeric material, having a sleeve portion defining an axial bore, a wheel portion, and a web extending radially from the wheel portion to the sleeve portion;

a one-piece, unitary shaft, composed of a polymeric material, defining an axial bore and having a mounting portion and a race portion, the race portion being rotatably disposed within the bore of the sleeve portion of the roller;

a washer, composed of case-hardened steel, defining an opening coaxial with the bore of the sleeve portion of the roller; and a pin, composed of case-hardened steel, having a head and a stem extending axially from the head through the opening of the washer and into the bore of the shaft, the stem having a knurled segment frictionally engaged within the bore of the shaft.

13. The roller assembly of claim 12 wherein the shaft further has a radially extending shoulder portion disposed intermediate the mounting portion and the race portion defining a shoulder adjacent the race portion of the shaft and the sleeve portion of the roller extends axially to a lip, the lip slidably engaging the shoulder of the shaft.

14. An upwardly-acting overhead door for selectively opening and closing an entry way having oppositely disposed sides, the door comprising:

a plurality of door panels extending from one side edge to an opposite side edge, the side edges being positioned proximate the sides of the entry way;

a plurality of hinges, each of the hinges comprising a pair of pivotally connected hinge halves associated with a pair of adjacent door panels and a hinge tube, each of the hinge halves being mounted to a respective one of the door panels adjacent a side edge of the door panel;

a pair of L-shaped tracks, one of the tracks being mounted along one side of the entry way and the other track being mounted along the opposite side of the entry way; and a plurality of roller assemblies, each of the roller assemblies comprising a shaft, a roller, a washer, and a pin, the roller having sleeve portion defining an axial bore, a wheel portion rollingly engaged with the track, and a web extending radially from the wheel portion to the sleeve portion, the shaft defining an axial bore and having a mounting portion and a race portion, at least a portion of the mounting portion being disposed within the hinge tube, the race portion being disposed within the bore of the sleeve portion of the roller and positioned at a distance from the side edge of the door, the pin having a head and a stem extending axially from the head through the opening of the washer into the bore of the shaft, the stem having a knurled segment frictionally engaged with the bore of the shaft.

15. The door of claim 14 wherein the each of the shafts has an outside diameter and each of the hinge tubes has an inside diameter, the inside diameter of the hinge tube being greater than the outside diameter of the shaft.

16. The door of claim 14 wherein the washer and pin are both composed of case-hardened steel.

17. The door of claim 14 wherein the shaft and roller are composed of polymeric material.

18. The door of claim 17 wherein the shaft is composed of a grade nylon and the roller is composed of nylon 6 with rubber modifiers.

19. The door of claim 17 wherein the shaft is composed of polybutylene terephthalate and the roller is composed of nylon 6 with rubber modifiers.

* * * * *